US006797331B2

(12) United States Patent
Singler et al.

(10) Patent No.: US 6,797,331 B2
(45) Date of Patent: Sep. 28, 2004

(54) PROCESS FOR PRODUCING A CHEMICAL-RESISTANT PROTECTIVE LAYER FOR A ROTARY BODY HAVING A BASE BODY MADE FROM FIBER-REINFORCED PLASTIC

(75) Inventors: Josef Singler, Wertingen (DE); Martin Endisch, Wertingen (DE); Gerhard Johner, Gelnhausen (DE); Markus Kirst, Büttelborn (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/161,817

(22) Filed: Jun. 4, 2002

(65) Prior Publication Data

US 2002/0187292 A1 Dec. 12, 2002

(30) Foreign Application Priority Data

Jun. 8, 2001 (DE) ..... 101 27 908

(51) Int. Cl.[7] ..... C23C 4/04

(52) U.S. Cl. ..... 427/450; 427/451; 427/453; 427/454; 427/455; 427/456; 427/185; 427/404; 427/413; 427/407.1; 427/419.2; 427/419.5; 427/419.7; 427/430.1; 427/443.1; 427/576; 427/569; 427/250; 427/248.1; 427/249.1; 204/192.14; 205/164

(58) Field of Search ..... 427/450, 451, 427/453, 454, 456, 455, 185, 404, 413, 407.1, 419.2, 419.5, 419.7, 430.1, 250, 443.1, 576, 248.1, 569, 249.1; 492/50, 53, 54; 204/192.14; 205/164

(56) References Cited

U.S. PATENT DOCUMENTS

| | | | | |
|---|---|---|---|---|
| 4,704,328 A | | 11/1987 | Imao et al. | |
| 5,387,172 A | | 2/1995 | Habenicht et al. | |
| 5,957,052 A | * | 9/1999 | Endisch et al. | 101/375 |
| 6,342,272 B1 | * | 1/2002 | Halliwell | 427/447 |

FOREIGN PATENT DOCUMENTS

| | | |
|---|---|---|
| CA | 2066149 | * 11/1992 |
| DE | 36 08 286 | 10/1986 |
| DE | 40 14 623 | 11/1991 |
| DE | 36 17 034 | 2/1992 |
| DE | 42 04 896 | 7/1995 |
| EP | 0 514 640 | 11/1994 |
| EP | 1 129 787 | 9/2001 |

* cited by examiner

*Primary Examiner*—Katherine A. Bareford
(74) *Attorney, Agent, or Firm*—Cohen, Pontani, Lieberman & Pavane

(57) ABSTRACT

A fiber-reinforced plastic base body is first of all provided with a coating of hard rubber or thermoplastic having a dispersed metal or ceramic content of 5% by volume to 80% by volume, and the coating is ground down to provide a smooth surface In a further step a layer of metal and/or ceramic, which has a printing function, is applied to the smooth surface, preferably by thermal spraying.

9 Claims, 1 Drawing Sheet

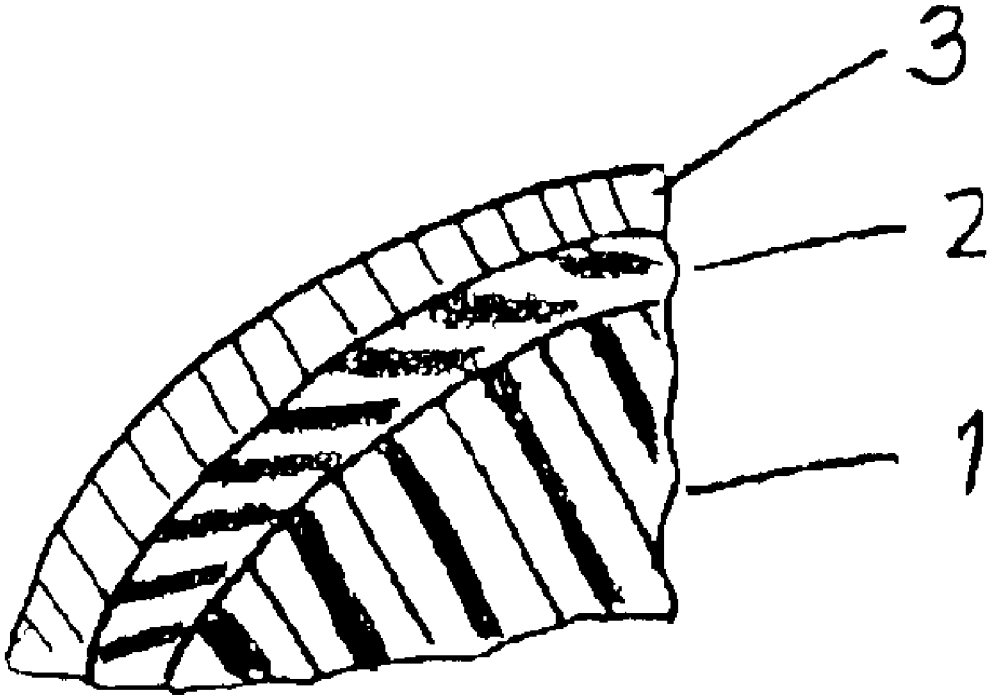
3
2
1

PROCESS FOR PRODUCING A CHEMICAL-RESISTANT PROTECTIVE LAYER FOR A ROTARY BODY HAVING A BASE BODY MADE FROM FIBER-REINFORCED PLASTIC

BACKGROUND OF THE INVENTION

1. Field of the Invention

The invention relates to a process for producing a chemical-resistant protective layer for a rotary body having a base body made from fiber-reinforced plastic, and to a rotary body having an interlayer and a functional layer.

2. Description of the Related Art

It is known that considerable advantages can be achieved by using fiber-reinforced plastics in mechanical engineering, automotive engineering and plant construction. These materials are more lightweight than metals and, given a suitable design, have at least equal mechanical properties, in particular when used for rapidly moving parts, such as shafts, rollers or the like.

Rapidly rotating rotary bodies or rolls of printing machines, which are produced from metal, are known to be exposed to considerable inertia forces for mass reasons, and these forces are disadvantageous in particular when the machine speeds change. Therefore, even now roll bodies made from fiber-reinforced, in particular carbon fiber-reinforced plastic, are already in use.

Without a chemical-resistant, corrosion-resistant coating, fiber-reinforced roll bodies for printing machines, such as dampening rolls, inking rolls, plate cylinders, blanket cylinders, and also for the sleeve technique, etc., can be rapidly damaged through interaction with printing auxiliaries. Examples of printing auxiliaries are inks, dampening agents, detergents and all substances which come into contact with the surfaces of the rolls.

It is fundamentally the case that any fiber-reinforced material can only retain its profile of properties if the matrix does not lose its adhesion to the fibers and there are no changes in dimensions, in the form of swelling or shrinking. In the case of fiber-reinforced plastics, for example, what is known as delamination as a result of the plastic matrix taking up water, associated with a dramatic loss of strength, is particularly feared.

It is known to coat fiber-reinforced plastics, in particular by thermal spraying, particular attention being paid to the problems of promoting adhesion (cf. for example DE 36 17 034 C2 and DE 36 08 286 A1), while the chemicals resistance of the coatings to protect the base body has hitherto been dealt with unspecifically, or has even not been dealt with at all.

DE 42 04 896 C2 has likewise disclosed coating a heat-sensitive base body made from fiber-reinforced epoxy resin by plasma spraying for a wear-resistant, chemically resistant, inorganic covering layer, or etched plastic layer, with a previously applied thermoplastic layer or etched plastic layer offering the adhesion for the adhesion promoter layer. The known extreme cooling rates of the sprayed particles during thermal spraying, of $10^5$–$10^6$ K/s, in particular in combination with the cooling measures required for fiber-reinforced plastics, such as liquid $CO_2$ cooling, etc., are scarcely able to achieve the desired adhesion-promoting effect whereby sprayed particles are completely incorporated in the thermoplastic layer.

In particular, EP 0 514 640 B1 also describes a process for coating fiber-reinforced plastic bodies by means of thermal spraying processes using an interlayer of synthetic resin in which ceramic particles are dispersed and which is ground down after curing, in order to offer the actual functional layer of metal or ceramic plastic-free adhesion points made from the same material. The insufficient chemicals resistance of an interlayer of synthetic resin of this type, and the fatal consequences for the fiber-reinforced plastic base body on contact with chemicals, such as for example printing auxiliaries, are not described.

SUMMARY OF THE INVENTION

The invention is therefore based on the object of producing a chemicals-resistant protective layer for fiber-reinforced plastic bodies and providing a rotary body having a base body made from fiber-reinforced plastic and a protective layer of this type, so that not only is it ensured that the base body is protected, but also a securely adhering join to a wear-resistant and corrosion-resistant functional layer above it, which is preferably to be applied by thermal spraying, is also provided.

The object on which the invention is based is achieved by first of all protecting the fiber-reinforced plastic component, i.e. the base body of a rotary body, with a layer of hard rubber or thermoplastic, in which metal or ceramic particles are dispersed in an amount of from 5% by volume–80% by volume. This layer is then ground down, and then the layer of hard rubber or thermoplastic is coated with a metal and/or ceramic layer, preferably by thermal spraying.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The sole FIGURE is a partial cross-section of a rotary body according to the invention.

DETAILED DESCRIPTION OF THE PRESENTLY PREFERRED EMBODIMENTS

Referring to the FIGURE, a base body 1 is provided with an interlayer 2 and a functional layer 3.

The chemical resistant interlayer of hard rubber or thermoplastic can be applied in a thickness of from 160 $\mu$m to 10 000 $\mu$m, preferably from 500 $\mu$m to 1000 $\mu$m, NBR (nitrile butadiene rubber) rubber coverings with a hardness of 40°–80° Shore D, preferably 80° Shore D, advantageously being used for classic offset applications.

EPDM (ethylene propylene diene monomer) rubber coverings of the same thickness and Shore hardness are particularly suitable for offset applications using UV-curing inks. Polyamide (nylon) is suitable, as a widespread thermoplastic, for both offset applications. While in the case of thermoplastic in the form of polyamide the chemical resistant interlayer is produced using the fluidized bed process with metal or ceramic particles being added at approx. 120° C.–140° C., in the case of the rubber coating the metal or ceramic particles have to be admixed, for example by being rolled or kneaded in, to the rubber compound at 140° C.–160° C. prior to the vulcanization in steam.

The chemical resistant interlayer, i.e. the coating of hard rubber or thermoplastic, has to be ground down until the dispersed metal or ceramic particles can also be seen in ground-down form at the surface. The metal or ceramic particles used are expediently commercially available spray powder as is used for thermal spraying.

The further coating of the fiber-reinforced plastic body which has been provided with the ground-down interlayer of hard rubber or thermoplastic preferably takes place according to the intended application (as a dampening, inking, guide, tensioning, beam or discharge roll, etc.), preferably by thermal spraying of suitable materials, such as for example oxide ceramic, on high-alloy chromium/nickel steel bonding layers for dampening roll applications or on wear-resistant hard material layers (WC/Co, $WC/Ni_2Cr_3C_2/NiCr$, NiCrBSi) for guide roll applications. It is particularly preferable for a functional printing layer to be applied to the ground-down coating of hard rubber or thermoplastic by plasma spraying of high-alloy chromium nickel steel and then of oxide ceramic, this layer being smoothed down to a roughness of $Rz \leqq 3.0\ \mu m$ by grinding, polishing, brushing or scrubbing, so that it can likewise preferably be used as a dampening roll surface.

The coating, i.e. the functional layer of the fiber-reinforced plastic body which is protected with the ground-down interlayer, may, of course, also be deposited by other comparably cold coating processes, such as electrodeposition, chemical deposition, cathode sputtering (PVD), sol/gel etc., with chromium, nickel, copper, oxide ceramic or combinations thereof being deposited.

The result of this process is a rotary body with a base body made of fiber-reinforced, in particular carbon fiber-reinforced plastic with a chemical resistant interlayer of hard rubber or thermoplastic which is applied thereto and has a dispersed metal or ceramic content of 5% by volume–80% by volume and is covered with in particular a printing functional layer of metal and/or ceramic.

Of course, the rotary body may also be a plastic printing sleeve which is provided with the chemical resistant protective coating produced in accordance with the invention and is drawn in this form onto a plate cylinder or rubber cylinder. The rotary body according to the invention may also be an engraved inking roll, in which case the surface of the chemical resistant protective layer consists of laser-engraved chromium oxide and therefore fulfils the function of an engraved inking roll for short inking units in offset, gravure and flexographic printing machines.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A process for producing a chemical resistant protective layer for a rotary body having a base body made of fiber-reinforced plastic, said process comprising applying a coating of rubber to a base body made of fiber-reinforced plastic, said rubber containing from 5% to 80% by volume of dispersed particles of one of metal and ceramic, said rubber comprising one of a nitrile butadiene rubber compound and an ethylene propylene diene monomer rubber compound, said rubber having a hardness of 40° Shore D to 80° shore D, grinding down said coating to produce a smooth surface, and applying a functional layer of at least one of metal and ceramic to said smooth surface.

2. A process as in claim 1 wherein said functional layer is applied by flame spraying.

3. A process as in claim 2 wherein said functional layer is a hard layer which protects against wear, said method further comprising smoothing said functional layer.

4. A process as in claim 3 wherein said functional layer comprises one of oxide ceramic WC/Co, WC/Ni, $Cr_3C_2$/NiCr, NiCrBSi and Mo.

5. A process as in claim 1 wherein said coating has a thickness of 150 $\mu$m to 1.0 cm.

6. A process as in claim 5 wherein said coating has a thickness of 500 $\mu$m to 1000 $\mu$m.

7. A process as in claim 1 wherein said functional layer is applied by thermal flame spraying of chromium nickel steel then of oxide ceramic, said method further comprising grinding and polishing said functional layer to a roughness of $Rz \leqq 3.0\ \mu m$.

8. A process as in claim 1 wherein said functional layer is deposited on said smooth surface by one of cathode sputtering, chemical deposition, electrodeposition, plasma CVD, and sol/gel.

9. A process as in claim 8 wherein said functional layer is at least one of chromium, copper, and oxide ceramic.

* * * * *